US005700183A

United States Patent [19]

Fletcher

[11] Patent Number: 5,700,183

[45] Date of Patent: Dec. 23, 1997

[54] SANDING WHEEL ASSEMBLY

[75] Inventor: M. Ray Fletcher, Lexington, N.C.

[73] Assignee: Fletcher Machine, Inc., Lexington, N.C.

[21] Appl. No.: 635,494

[22] Filed: Apr. 22, 1996

[51] Int. Cl.[6] ..... B24B 19/24

[52] U.S. Cl. ..... 451/182; 451/520

[58] Field of Search ..... 451/499, 500, 451/496, 520, 182

[56] References Cited

U.S. PATENT DOCUMENTS

| | | | |
|---|---|---|---|
| 346,680 | 8/1886 | Perry | 451/520 |
| 399,629 | 3/1889 | Perry | 451/520 |
| 1,992,105 | 2/1935 | Walker | 451/499 |
| 4,744,180 | 5/1988 | Voorhees | 451/490 |

FOREIGN PATENT DOCUMENTS

| | | | |
|---|---|---|---|
| 12113 | 5/1914 | United Kingdom | 451/520 |

*Primary Examiner*—Robert A. Rose

[57] ABSTRACT

A sanding wheel assembly is provided which allows the operator to quickly change and replace worn sanding belts. The device includes a pinion joined to a rachet wheel which controls a series of tensioning levers. A manual latch secures a rachet wheel. As the pinion is rotated, the levers move inwardly or outwardly to change the tension on the sanding belt against a sanding ring for belt tightening or removal purposes.

14 Claims, 2 Drawing Sheets

SANDING WHEEL ASSEMBLY

BACKGROUND OF THE INVENTION

1. Field of the Invention

The invention herein pertains to a sanding wheel assembly as affixed to sanding and shaping machines which are generally driven by electric motors as used in the furniture and related trades. The sanding wheel assembly utilizes a conventional endless sanding belt which will conform to the particular contours of the sanding wheel assembly and is easily replaceable when worn.

2. Description of the Prior Art and Objectives of the Invention

It is usual in the furniture industry to form contoured edges on desk tops, table tops, chairs and other items by the use of sanding wheels having contoured faces. Two or more such sanding wheels are generally employed on most machines used in the mass production of furniture. Various types of paper and fabric endless sanding belts are placed on sanding wheels and tightened mechanically or otherwise. After the sanding belts are worn so as to be ineffective, they are loosened, removed and replaced with a fresh sanding belt. In recent years fabric sanding belts have been developed having some elasticity or resilience to improve the ability of the sanding belt to closely engage the contours of the particular sanding wheel and to provide a closer and more durable fit.

As sanding belts must be frequently replaced during normal sanding operations, a particular concern of the operator has been the ease and convenience of replacing worn belts since labor and machine down-time can greatly impact the entire furniture manufacturing operation. Another concern has been the ability of the sanding machine operator to easily change the sanding wheel contours as different shaped furniture components are needed in manufacturing.

Thus, with the shortcomings and lack of versatility of current sanding wheel assemblies, the present invention was conceived and one of its objectives is to provide a sanding wheel assembly which can be easily installed on a conventional sanding wheel machine with little training.

It is another objective of the invention to provide a sanding wheel assembly in which the sanding ring can be changed for another having a different contoured face.

It is still another objective of the present invention to provide a sanding wheel assembly in which a worn sanding belt can be easily and rapidly replaced without undue machine downtime.

A further objective of the present invention is to provide a sanding wheel assembly that is durable and relatively trouble-free in its operation.

Various other objectives and advantages of the invention will become apparent to those skilled in the art as a more detailed description is set forth below.

SUMMARY OF THE INVENTION

The aforesaid and other objectives are realized by providing a sanding wheel assembly for attachment to a motor driven shaft of a commercial sanding machine. The sanding wheel assembly includes a sanding ring having a desired contoured face formed from a silicone rubber which has been vulcanized to an aluminum hub. A series of tensioning levers are mounted on a rachet wheel and the sanding ring includes a series of notches which receive posts affixed to the tensioning levers as the rachet wheel is rotated. The lever posts engage a circular sanding belt and as the rachet wheel is turned, the posts travel radially inwardly into the sanding ring notches to thereby tighten the belt and hold it against the outer contour of the sanding ring. To replace the belt when it is worn, a manual latch is depressed and the rachet wheel assembly is then turned by a pinion in the opposite direction, thereby releasing the tensioning lever posts to then release the sanding belt for replacement purposes. A new sanding belt is installed and the rachet wheel is turned by thee pinion in the opposite direction to cause the belt to tighten into the sanding ring.

DETAILED DESCRIPTION OF THE PREFERRED EMBODIMENT AND OPERATION OF THE INVENTION

Figure 1:
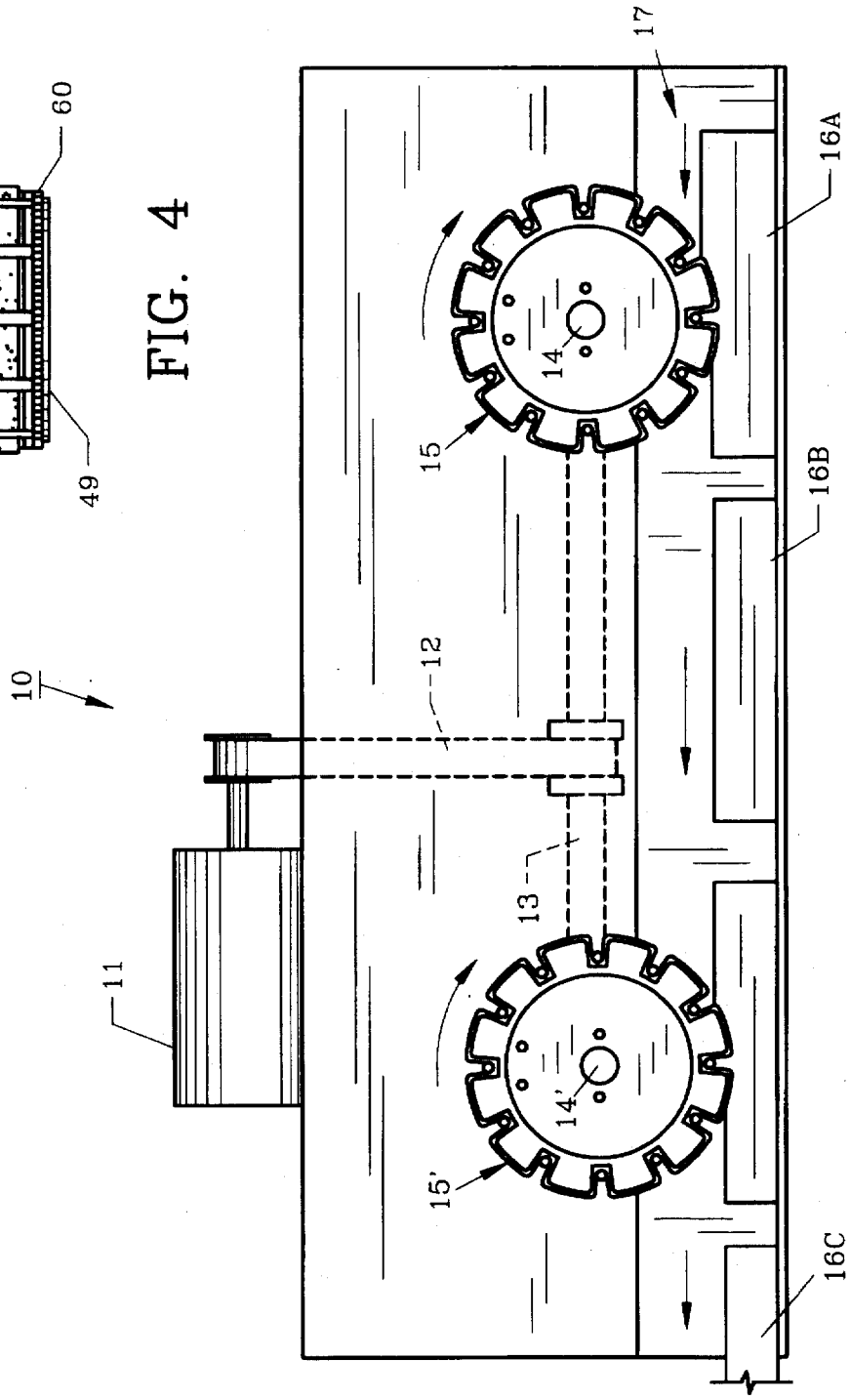
FIG. 1 is a top schematic view of a sanding machine utilizing a pair of sanding wheels.

For a better understanding of the invention and its operation, turning now to the drawings, FIG. 1 shows a schematic representation of a conventional sanding machine 10 as may be used in the furniture industry. Sanding machine 10 includes an electric motor 11 which drives belt 12 to turn shaft 13, which in turn rotates vertical shafts 14, 14' such as by simple gear or belt mechanism (not shown). Shafts 14, 14' are attached to sanding wheel assemblies 15, 15' of the invention. As shown, wooden furniture part 16A moves along guide 17 (from right to left in FIG. 1) where it encounters sanding wheel 15 and is shaped and Somewhat reduced in size as seen by part 16B. Part 16B is then contoured by sanding wheel assembly 15' where it is further reduced in size as shown by finished part 16C. As would be understood, sanding wheel assemblies 15, 15' may have the same or different face contours depending on the particular part requirements as will be hereinafter more fully explained.

Figure 4:
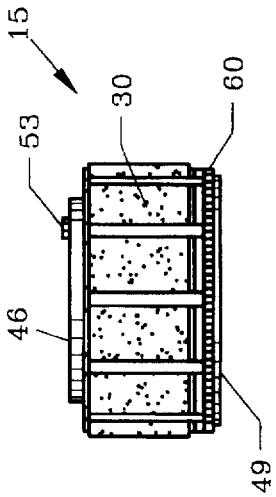
FIG. 4 is a side view of the sanding wheel assembly as shown in FIG. 3.
Figures 2, 3:
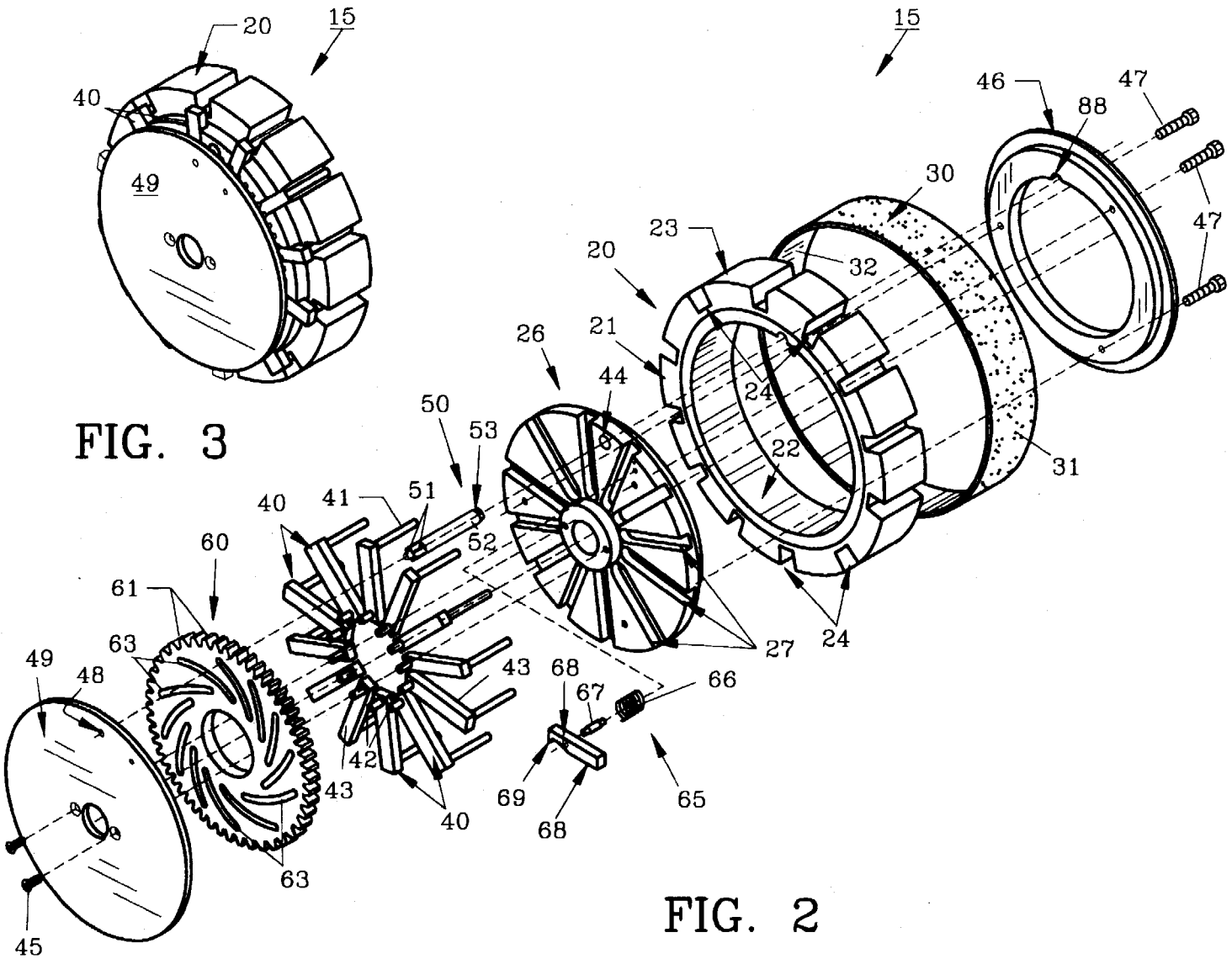
FIG. 2 is an exploded view of the preferred form of the sanding wheel assembly of the present invention.
FIG. 3 is a bottom, side perspective view of the sanding wheel assembly.

In FIG. 2, the preferred sanding wheel assembly 15 is shown in exploded fashion and includes sanding ring 20 having a relatively hard outer silicon rubber component 21 which is vulcanized to aluminum hub 22. Component 21 can be formed with a variety of outer contours, and as shown in FIG. 2, silicon rubber component 21 has a relatively flat periphery or outer surface 23 which is divided by notches 24 therearound. Endless sanding belt 30, having a selected grit size outer surface 31, includes a flexible fabric backing 32 which is somewhat elastic. When assembled, metal tensioning lever posts 41 of metal tensioning levers 40 engage the outer surface of sanding belt 30 and urge sanding belt 30 tightly into notches 24. Tensioning levers 40 (operated by the rotation of pinion 50) include a stud 42 affixed to linear radial member 43. Radial member 43 consists of a steel bar which may be approximately 9×12 mm, post 41 which may be approximately 6 mm in diameter and studs 42 may be approximately 12 mm in diameter. Pinion 50 includes a plurality of teeth 51 affixed to shaft 52. Shaft 52 provides a shoulder 53 which is exposed as seen in FIG. 4 for rotation with a wrench or the like. As would-be understood, as pinion 50 is rotated, teeth 51 engage teeth 61 of rachet wheel 60 thereby driving tensioning lever studs 42 along arcuate grooves 63 for tightening or loosening sanding belt 30 as desired.

In order to prevent inadvertent slippage or turning of rachet wheel 60 during operation, latch 65 is provided which is spring-loaded by coiled spring 66 affixed to latch axle 67. Latch lever 68 includes nose 69 which engages rachet wheel teeth 61 to prevent rachet wheel 60 from turning. By applying finger pressure to latch lever 68, nose 69 is disengaged from rachet wheel teeth 61 to then allow pinion 50 to direct tensioning lever post 41 into or our of sanding ring notches 24 as desired.

Guide plate 26 is mounted below sanding ring 20 and includes a plurality of lever grooves 27 for receiving radial members 43. Thus, as pinion 50 is turned, radial members 43 slide within radial grooves 27 of guide plate 26.

Sanding ring cover plate 46 is affixed to guide plate 26 by bolts 47. Sanding ring cover plate 46 is formed from aluminum whereas rachet wheel cover plate 49 formed from steel is affixed to guide plate 26 by bolts 45. In FIG. 3, rachet wheel cover plate 49 is shown positioned below sanding ring 20 and tension levers 40. In FIG. 4, shoulder 53 of pinion 50 is seen exposed above sanding ring cover plate 46 for easy access by a crescent or other wrench for rotation purposes.

The method of using sanding wheel assembly 15 is relatively simple in that a worn sanding belt 30 can be exchanged for a new one by applying manual pressure to latch lever 68 which is biased closed. As nose 69 disengages from rachet wheel teeth 61, a wrench can be positioned on shoulders 53 and pinion 50 rotated to move post 41 radially outwardly, out of notches 24. Sanding belt 30 can then be easily removed and a new sanding belt 30 put in place. If another contour is desired, sanding ring 20 can be replaced with a sanding ring having the desired face contour, and then a new belt 30 placed thereon. Pinion 50 is then rotated in the opposite direction, driving posts 41 into notches 24 to tighten belt 30 against the face 23 of sanding ring 20. Latch 65 then maintains rachet wheel 60 and associated tensioning levers 40 in place to secure the new sanding belt 30.

Ratchet wheel cover plate 49 defines aperture 48. Guide plate 26 defines aperture 44. Sanding wheel cover plate 46 defines channel 88. Pinion 50 is positioned in apertures 48 and 44, and channel 88.

The illustrations and examples provided herein are for explanatory purposes and are not intended to limit the scope of the appended claims.

I claim:

1. A sanding wheel assembly utilizing an endless sanding belt comprising: a sanding ring, said sanding ring defining a notch, a rachet wheel, said rachet wheel defining an arcuate slot, a belt tensioning lever, said tensioning lever contiguous to said rachet wheel, a guide plate being mounted between said sanding ring and said rachet wheel, said guide plate defining a pinion aperture, a ratchet wheel cover plate being positioned contiguous to said rachet wheel, said ratchet wheel cover plate defining a pinion aperture, a pinion engaging said rachet wheel and being positioned in the apertures defined by said guide wheel and said ratchet wheel cover plate, whereby rotating said rachet wheel relative to said sanding ring will cause said tensioning lever to urge said sanding belt into said notch to tighten said sanding belt on said sanding ring.

2. The sanding wheel assembly of claim 1 wherein said rachet wheel further comprises a plurality of teeth, said teeth positioned on the periphery of said rachet wheel.

3. The sanding wheel assembly of claim 1 wherein said tensioning lever comprises a stud, a belt post and a radial member, said stud and said belt post attached at opposite ends of said radial member, said stud slidably mounted within said arcuate slot.

4. The sanding wheel assembly of claim 1 wherein said guide plate defines a radial groove and said tensioning lever positioned within said radial groove.

5. The sanding wheel assembly of claim 1 further comprising a plurality of belt tensioning levers.

6. The sanding wheel assembly of claim 1 further comprising a sanding ring cover, said sanding ring cover contiguous to said sanding ring, said sanding ring cover defining a pinion channel, and said pinion positioned in said sanding ring cover channel and extending therebeyond.

7. The sanding wheel assembly of claim 1 wherein said sanding ring defines a plurality of notches, said notches circumferentially positioned around said sanding ring.

8. A cylindrically-shaped sanding wheel assembly utilizing an endless sanding belt for rotation by a shaft for contouring materials, the sanding wheel assembly comprising: a resilient sanding ring for retaining said sanding belt, said sanding ring defining a plurality of circumferential notches, a rachet wheel, said rachet wheel defining a series of arcuate slots arrayed therein, a plurality of tensioning levers, each of said tensioning levers comprising a stud, a belt post, and a radial member, one each of said studs mounted in a different one of said arcuate slots, a guide plate, said guide plate defining a pinion aperture, said guide plate positioned contiguous to said sanding ring, said guide plate defining a plurality of radial grooves, one each of said radial members mounted in different ones of said radial grooves, each of said belt posts mounted in different ones of said circumferential notches, a rachet wheel cover, said rachet wheel cover positioned contiguous to said rachet wheel, said rachet wheel cover defining a pinion aperture, a sanding wheel cover, said sanding wheel cover defining a pinion channel, a pinion, said pinion engaging said rachet wheel, said pinion positioned in said sanding wheel cover channel, in said guide plate pinion aperture, and in said ratchet wheel cover aperture, whereby rotation of said pinion in one direction causes said rachet wheel to turn, driving said belt post into said sanding ring notches to tighten said sanding belt and rotation of said pinion in an opposite direction causes said rachet wheel to turn to loosen said sanding belts.

9. The sanding wheel assembly of claim 8 wherein said guide plate further defines a pinion aperture and said pinion extending through said pinion aperture.

10. The sanding wheel assembly of claim 8 wherein said pinion further comprises a shaft, a plurality of teeth, said teeth positioned on said shaft.

11. The sanding wheel assembly of claim 8 further comprising a latch, said latch pivotally mounted to engage said rachet wheel.

12. The sanding wheel assembly of claim 11 wherein said latch is spring-loaded.

13. A device for tensioning a sanding belt, the device comprising:

(a) a sanding ring defining a plurality of axial notches along its circumference;

(b) a guide plate positioned proximate said sanding ring, said guide plate defining a plurality of radial grooves and a pinion aperture;

(c) a plurality of tensioning levers, each of said tensioning levers comprising an elongated radial member, a post perpendicularly attached to one end of the radial member, and a stud perpendicularly attached to the opposite end of the radial member, each one of the radial members being slidably carried by one each of the radial grooves, each one of the posts being positionable within one each of the axial notches, the axial notches for receiving the sanding belt, and the posts for positioning above the sanding belt;

(d) a ratchet wheel positioned proximate said guide plate, said ratchet wheel comprising a plurality of teeth along its circumference, said ratchet wheel defining a plurality of arcuate grooves, one each of the studs being slidably carried by one each of the arcuate grooves, said ratchet wheel being rotatable relative to said guide plate;

(e) a sanding ring cover positioned over said sanding ring and defining a pinion channel;

(f) a ratchet wheel cover positioned over said ratchet wheel and defining a pinion aperture; and (g) a rotatable pinion being engageable with the teeth of said ratchet wheel, said pinion positioned in said pinion apertures defined by said guide plate and said ratchet wheel cover and in said sanding ring cover channel, and extending beyond said sanding ring cover;

whereby said pinion can be rotated in one direction to tension the sanding belt, and in the opposite direction to loosen the sanding belt.

14. The device of claim 13, further comprising a latch lever engaging said teeth of said ratchet wheel, and a spring, said spring contacting said latch lever for biasing said latch lever into engagement with said teeth.

* * * * *